US005310392A

United States Patent [19]

Lo

[11] Patent Number: 5,310,392

[45] Date of Patent: May 10, 1994

[54] MAGNET-TYPE RESISTANCE GENERATOR FOR AN EXERCISE APPARATUS

[75] Inventor: Peter K. Lo, Taichung, Taiwan

[73] Assignee: Johnson Metal Industries Co., Ltd., Taichung Hsien, Taiwan

[21] Appl. No.: 98,427

[22] Filed: Jul. 27, 1993

[51] Int. Cl.[5] ..... A63B 69/16; A63B 21/24

[52] U.S. Cl. ..... 482/63; 482/5; 482/903

[58] Field of Search ..... 482/57, 63, 1-9, 482/903

[56] References Cited

U.S. PATENT DOCUMENTS

| | | | |
|---|---|---|---|
| 4,752,066 | 6/1988 | Housayama | 482/63 |
| 4,775,145 | 10/1988 | Tsuyama | 482/63 |
| 5,031,901 | 7/1991 | Saarinen | 482/63 |
| 5,094,447 | 3/1992 | Wang | 482/63 |
| 5,145,480 | 9/1992 | Wang | 482/63 |

*Primary Examiner*—Stephen R. Crow
*Attorney, Agent, or Firm*—Reinhart, Boerner, Van Deuren, Norris & Rieselbach

[57] ABSTRACT

A magnet-type resistance generator is to be used with an exercise apparatus which has a flywheel and includes a magnet unit with a curved housing which confines a groove and which has opposite inner wall surfaces that are respectively provided with a plurality of permanent magnets which extend into the groove. A tubular sleeve extends from a rear side of the curved housing and has a distal end which is formed with an internally threaded portion. The tubular sleeve is received slidably in a tubular slide seat. A guide bolt extends axially into the slide seat and has a threaded portion that engages the internally threaded portion of the tubular sleeve. A slide potentiometer has a slider connected to the curved housing of the magnet unit. An instrument control unit activates a motor to rotate the guide bolt axially and cause the tubular sleeve to move slidably in the slide seat, thereby moving the magnet unit toward or away from the periphery of the flywheel so that the periphery of the flywheel can extend into the groove of the curved housing by a desired depth in order to attain a desired resistance to rotation of the flywheel. The slider moves with the magnet unit to permit the slide potentiometer to control the instrument control panel to deactivate the motor when the desired depth has been reached.

2 Claims, 9 Drawing Sheets

MAGNET-TYPE RESISTANCE GENERATOR FOR AN EXERCISE APPARATUS

BACKGROUND OF THE INVENTION

1. Field of the Invention

The invention relates to an exercise apparatus, more particularly to an improved magnet-type resistance generator for an exercise apparatus.

2. Description of the Related Art

Exercise apparatuses with magnet-type resistance generators are known in the art. FIGS. 1 and 2 illustrate a conventional exercise bicycle which incorporates a magnet-type resistance generator. The resistance generator includes a magnet unit (B) which pivots frontward and rearward and which is disposed adjacent to a periphery of a flywheel (A) of the exercise bicycle. When the magnet unit (B) pivots frontward, the periphery of the flywheel (A) cuts into a magnetic field that is generated by the magnet unit (B). Referring to FIG. 3 , the magnet unit (B) utilizes several spaced pairs of oppositely polarized permanent magnets (B1) to generate the magnetic field.

A cantilever (C) is disposed on one side of the flywheel (A). A link mechanism (D) mounts pivotally the magnet unit (B) on the cantilever (C). The link mechanism (D) includes a pair of parallel cranks (D1). A shaft sleeve (D2) is provided on each end of each crank (D1). Each shaft sleeve (D2) is formed with an axial through hole (D3). A rocking arm (E) interconnects the upper ends of the cranks (D1). The rocking arm (E) has a rear side which is secured to a side wall of the magnet unit (B), and a front side which is formed with a spaced pair of frontwardly extending shafts (E1). Each of the shafts (E1) extends into the shaft sleeve (D2) on the upper end of the respective crank (D1). Nuts (D4) engage the distal ends of the shafts (El) so as to mount the cranks (D1) pivotally on the rocking arm (E). The cantilever (C) has a front side which is formed with a spaced pair of frontwardly extending shafts (C1). Each of the shafts (C1) extends into the shaft sleeve (D2) on the lower end of the respective crank (D1). Nuts (D4) engage the distal ends of the shafts (C1) so as to mount the cranks (D1) pivotally on the cantilever (C). A push piece (D5) is secured on the upper end of one of the cranks (D1). The push piece (D5) is formed with a vertically extending notch (D6). The distal end of a bent pull shaft (F1) is received in the notch (D6) and is movable upwardly and downwardly therein. The other end of the pull shaft (F1) is connected to a slide piece (F2) of a bolt unit (F). The slide piece (F2) is mounted threadedly on a guide bolt (F4) that is driven rotatably by a motor (F3). A gear (F5) is secured on a distal end of the guide bolt (F4). The gear (F5) meshes with another gear (F51) which is driven rotatably by the motor (F3). The upper end of the slide piece (F2) is formed with an upwardly extending rod (F21). A slide potentiometer (F6) is disposed parallel to the guide bolt (F4). The rod (F21) moves a slider (not shown) of the slide potentiometer (F6) frontward and rearward. Referring to FIG. 4, the slide potentiometer (F6) is connected electrically to a voltage sensor. The voltage sensor includes a position sensor (G11) and a position control (G12) and is connected electrically to a computer (G2). The computer (G2) is connected to a motor control unit (G) which, in turn, is connected to the motor (F3) so as to control the rotation of the latter.

Referring once more to FIGS. 1 to 4, an instrument control unit (H) is operated so as to adjust the resistance that is to be provided by the bicycle exerciser to the desired level. The computer (G2), which is disposed in the instrument control unit (H), commands the motor control unit (G) to activate the motor (F3) and rotate the gears (F5, F51) in order to rotate correspondingly the guide bolt (F4). The slide piece (F2) moves forward or rearward in accordance with the direction of rotation of the motor (F3) and moves the pull shaft (F1) therewith. Movement of the pull shaft (F1) causes forward or rearward pivoting movement of the link mechanism (D). At the same time, the rod (F21) moves the slider of the slide potentiometer (F6) frontward or rearward, thereby adjusting the resistance output of the latter. The position sensor (G11) and the position control (G12) generate a control signal to the computer (G2) in accordance with the instantaneous resistance output of the slide potentiometer (F6). The computer (G2) continues to command the motor control unit (G) to activate the motor (F3) until the desired resistance to the rotation of the flywheel (A) is attained. When the link mechanism (D) pivots forward, the periphery of the flywheel (A) cuts deeper into the magnetic field that is generated by the magnet unit (B), thereby resulting in a larger resistance to the rotation of the flywheel (A). When the link mechanism (D) pivots rearward, a smaller portion of the periphery of the flywheel (A) cuts into the magnetic field that is generated by the magnet unit (B), thereby resulting in a smaller resistance to the rotation of the flywheel (A). When the flywheel (A) ceases to cut into the magnetic field that is generated by the magnet unit (B), no resistance to the rotation of the flywheel (A) is produced.

From the foregoing, it has been shown that in order to convert the rotation of the motor (F3) into pivoting movement of the link mechanism (D) and the magnet unit (B), movement of several components, such as the gears (F5, F51), the guide bolt (F4), the slide piece (F2), and the pull shaft (F1), is required. This results in a relatively large tolerance. The following are some of the drawbacks of the above described resistance generator:

1. Referring once more to FIGS. 1 and 3, the magnet unit (B) confines a groove (B2) between the spaced pairs of oppositely polarized permanent magnets (B1). The periphery of the flywheel (A) extends into the groove (B2) such that the permanent magnets (B1) are disposed on two sides thereof. In order for the flywheel (A) to cut equally through the magnetic lines of the permanent magnets (B1), the flywheel (A) must be disposed at the center of the groove (B2). However, because of the presence of the relatively large tolerance, the flywheel (A) usually does not cut equally through the magnetic lines. This often results in an unstable resistance to the rotation of the flywheel (A). The exercise apparatus thus becomes uncomfortable to use and can result in uneven muscle development.

2. Proper installation and adjustment of the magnet unit (B) is difficult to achieve. When the magnet unit (B) accidentally bumps into an object, the flywheel (A) is easily displaced from its proper position.

3. Note that the instrument control unit (H) is operable in order to set the desired calorie loss and to compute the actual calorie loss. To compute the calorie loss, two factors are required: the rotational speed of the flywheel (A) in revolutions per minute, and the resistance offered by the resistance generator to the rotation of the flywheel (A). As mentioned hereinbefore, the resistance to the rotation of the flywheel (A) is usually uneven. Thus, the computed calorie loss is usually inaccurate.

SUMMARY OF THE INVENTION

Therefore, the main objective of the present invention is to provide an improved magnet-type resistance generator for an exercise apparatus which is comfortable to use and which can ensure that the resistance to the rotation of the flywheel is uniform.

Another objective of the present invention is to provide an improved magnet-type resistance generator for an exercise apparatus which can compute the calorie loss accurately.

Accordingly, the magnet-type resistance generator of the present invention is to be installed on an exercise apparatus with a flywheel and comprises:

a magnet unit including a curved housing which has a U-shaped horizontal cross-section, the curved housing confining a groove and having opposite inner wall surfaces that are respectively provided with a plurality of permanent magnets which extend into the groove, the groove having a shape which conforms with a periphery of the flywheel;

a tubular sleeve extending from a rear side of the curved housing and having a distal end which is formed with an internally threaded portion;

a tubular slide seat mounted on the exercise apparatus adjacent to the flywheel, the slide seat confining a through hole to receive slidably the tubular sleeve therein;

a guide bolt extending axially into the slide seat and having a threaded portion that engages the internally threaded portion of the tubular sleeve, the guide bolt further having a distal end which extends out of the slide seat and which is provided with a first transmission gear;

a motor having an axle which is provided with a second transmission gear that meshes with the first transmission gear;

a slide potentiometer mounted on the exercise apparatus, the slide potentiometer having a slider connected to the curved housing of the magnet unit; and an instrument control unit mounted on the exercise apparatus and connected electrically to the slide potentiometer, the instrument control unit activating the motor to rotate the guide bolt axially and cause the tubular sleeve to move slidably along the through hole of the slide seat, thereby moving the magnet unit toward or away from the periphery of the flywheel so that the periphery of the flywheel can extend into the groove of the curved housing by a desired depth in order to attain a desired resistance to rotation of the flywheel, the slider moving with the magnet unit to permit the slide potentiometer to control the instrument control panel to deactivate the motor when the desired depth has been reached.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 5:
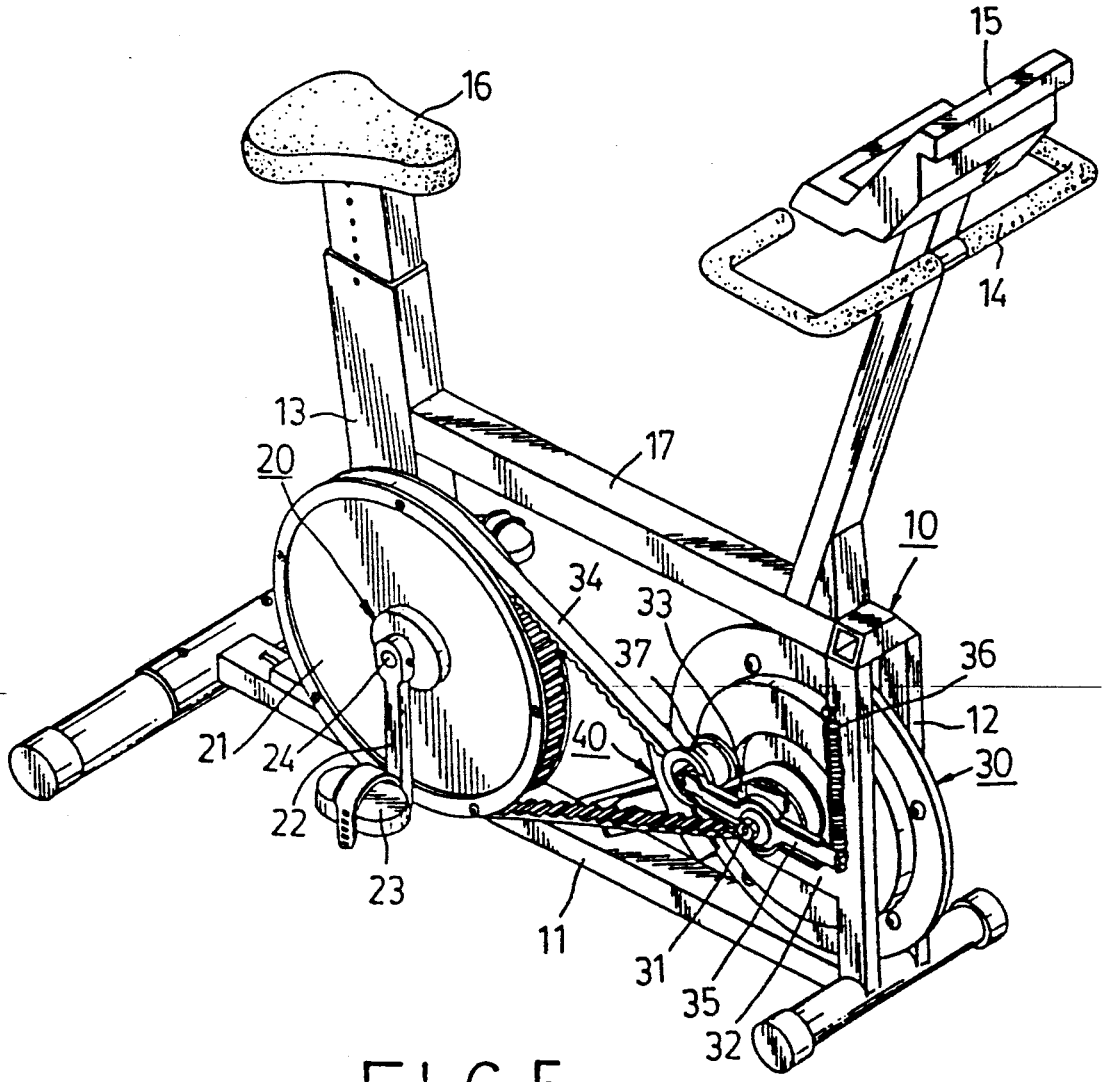
FIG. 5 is a perspective view of an exercise apparatus with the preferred embodiment of a magnet-type resistance generator according to the present invention.
Figure 6:
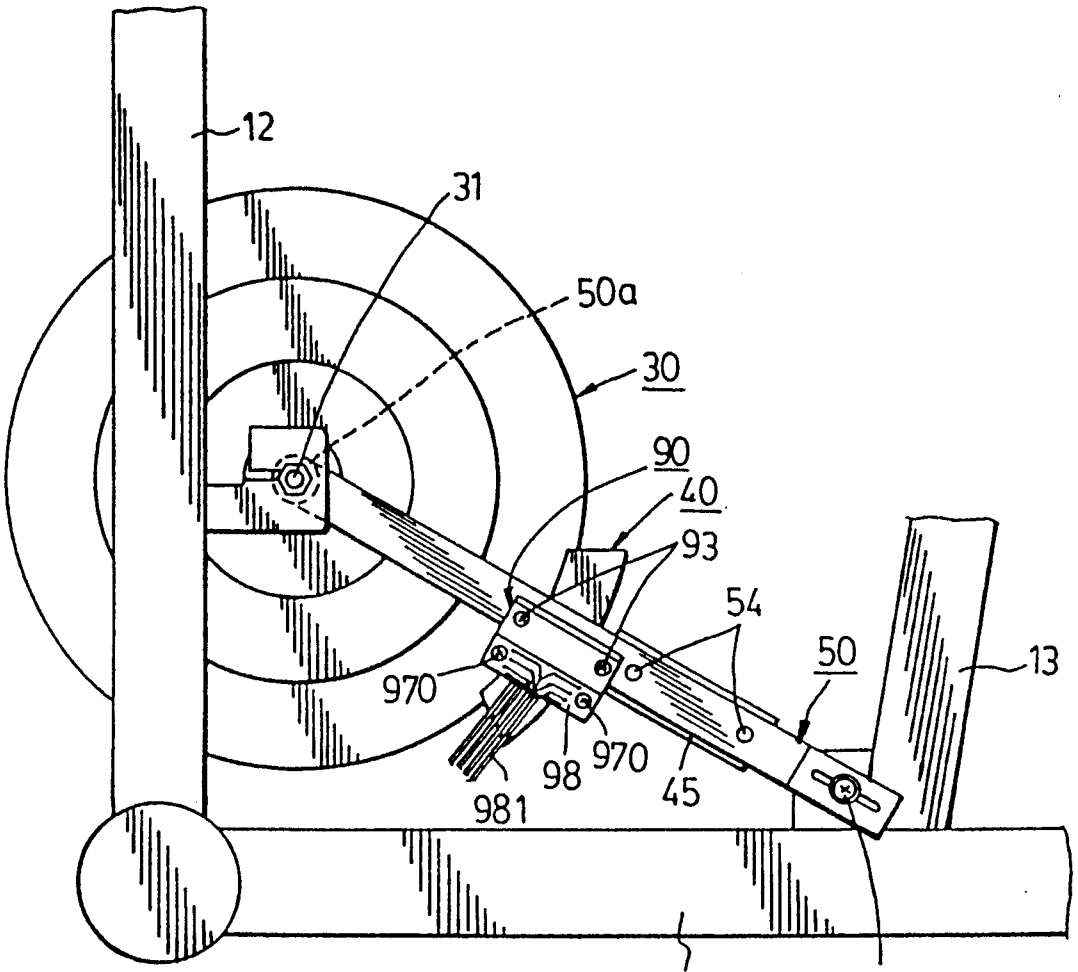
FIG. 6 is a fragmentary side view of the preferred embodiment when mounted on the exercise apparatus.
Figure 7:
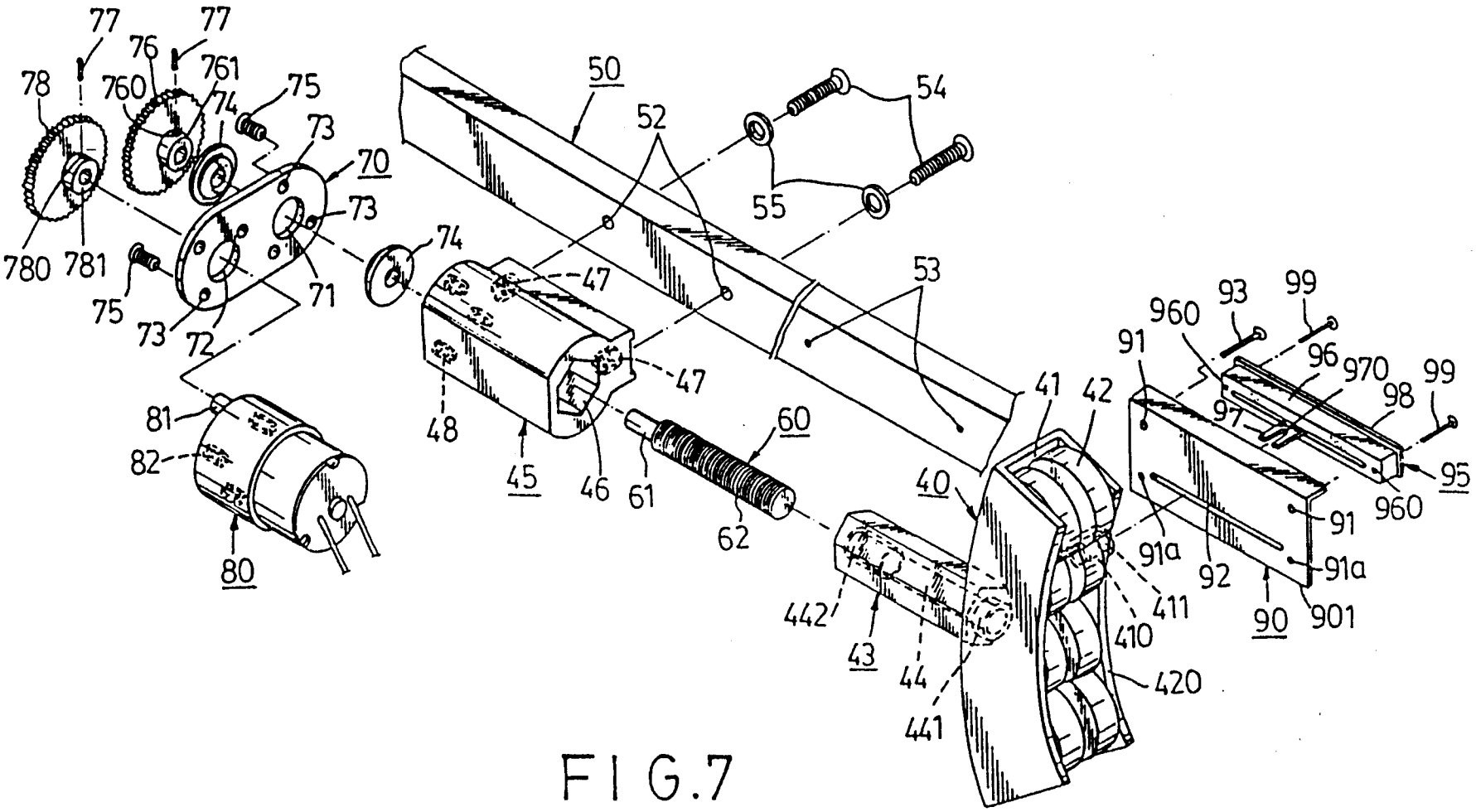
FIG. 7 is an exploded view of the preferred embodiment.

Referring to FIGS. 5, 6 and 7, an exercise apparatus which incorporates the magnet-type resistance generator of the present invention is shown to comprise a frame assembly 10, a manually operated driving unit 20 and a driven flywheel 30. The magnet-type resistance generator includes a magnet unit 40, a tubular threaded sleeve 43, a tubular slide seat 45, an inclined support 50, a guide bolt 60, mounting plates 70, 90, a motor 80 and a slide potentiometer 95.

In this embodiment, the frame assembly 10 is an exercise bicycle frame and includes an H-shaped base 11, a wheel support 12 which extends upwardly from a front portion of the base 11, and a seat support 13 which extends upwardly from a rear portion of the base 11. The top end of the wheel support 12 is provided with a handle unit 14 and an instrument control unit 15. A seat 16 is mounted on a top end of the seat support 13 in a known manner. The frame assembly 10 further includes a horizontally extending frame member 17 which extends between the wheel support 12 and the seat support 13.

The manually operated driving unit 20 includes a drive shaft 24 journalled on a lower portion of the seat support 13, a driving wheel 21 sleeved rigidly on the drive shaft 24, two crank arms 22 respectively secured to two ends of the drive shaft 24, and two pedals 23 respectively carried on the crank arms 22. In this embodiment, the driving wheel 21 is a belt wheel.

A front shaft 31 is secured to a hook portion 32 that is formed on an intermediate part of the wheel support 12. The driven flywheel 30 is sleeved rotatably on the front shaft 31 and has one side which is provided with a driven wheel 33. In this embodiment, the driven wheel 33 is a sprocket and is mounted on the front shaft 31 by means of a unidirectional clutch (not shown). An endless driving element 34, such as a driving belt, is trained between the driving wheel 21 and the driven wheel 33. Rotation of the flywheel 30 is permitted in only one direction.

A press rod 35 has an intermediate section which is mounted pivotally on an outer side of the hook portion 32 of the wheel support 12. A tension spring 36 has one end connected to a corresponding end of the press rod 35. The other end of the tension spring 36 is fixed to the wheel support 12. A tensioning wheel 37 is mounted rotatably on the other end of the press rod 35 by means of bearings (not shown). The tension spring 36 pulls one end of the press rod 35 in order to enable the tensioning wheel 37 to apply pressure on a portion of the driving element 34 so as to tauten the same.

Figure 1:
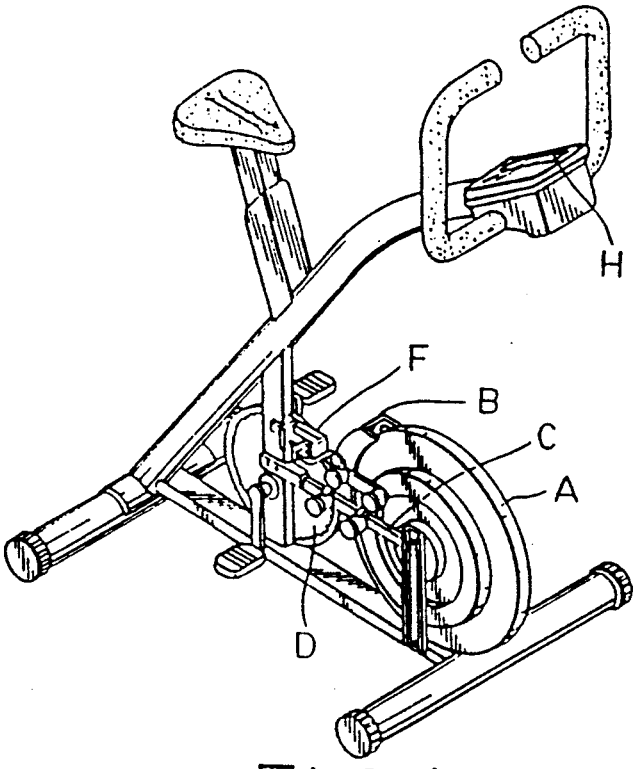
FIG. 1 PRIOR ART
FIG. 1 is a perspective view of an exercise apparatus with a conventional magnet-type resistance generator.
Figure 2:
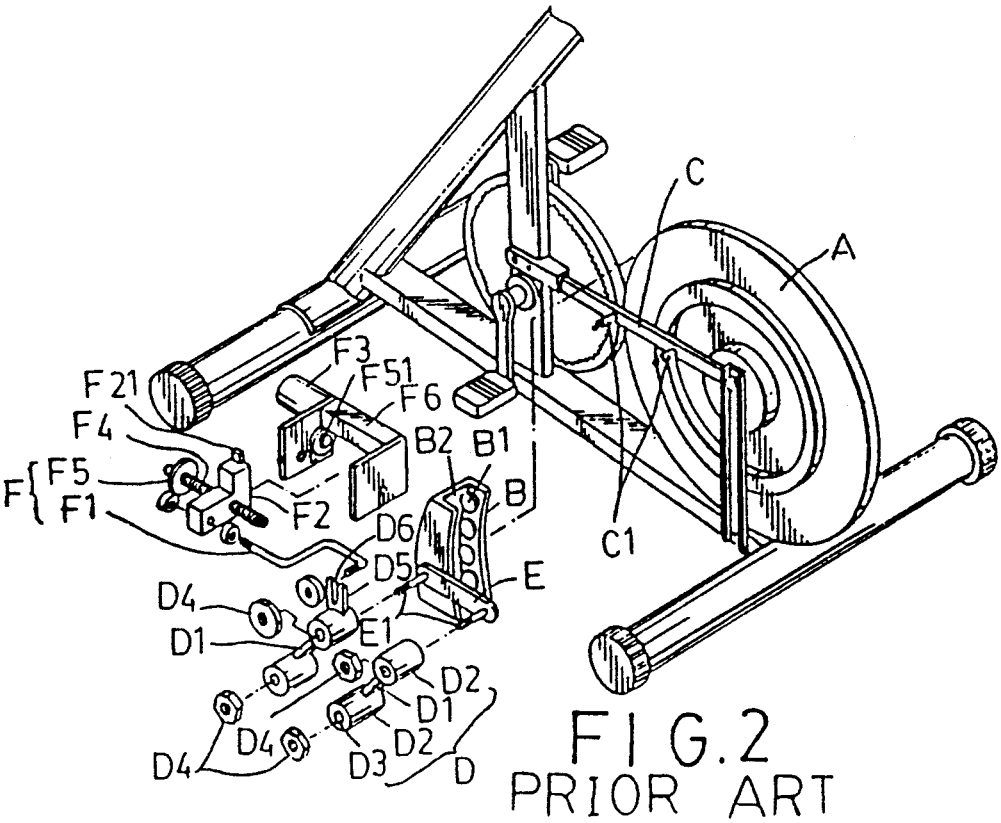
FIG. 2 PRIOR ART
FIG. 2 is an exploded view of the conventional magnet-type resistance generator shown in FIG. 1.
Figure 3:
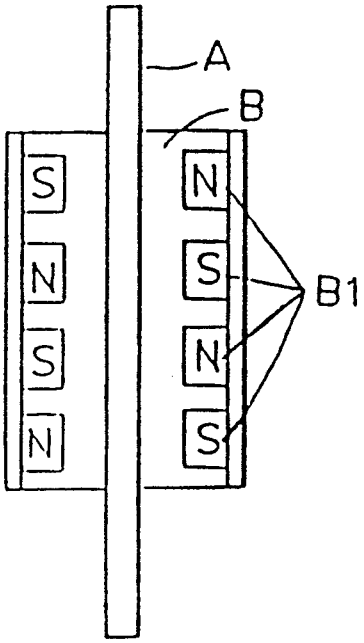
FIG.3 PRIOR ART
FIG. 3 is a front view illustrating how a magnet unit of the conventional resistance generator resists the rotation of a flywheel of the exercise apparatus.
Figure 4:
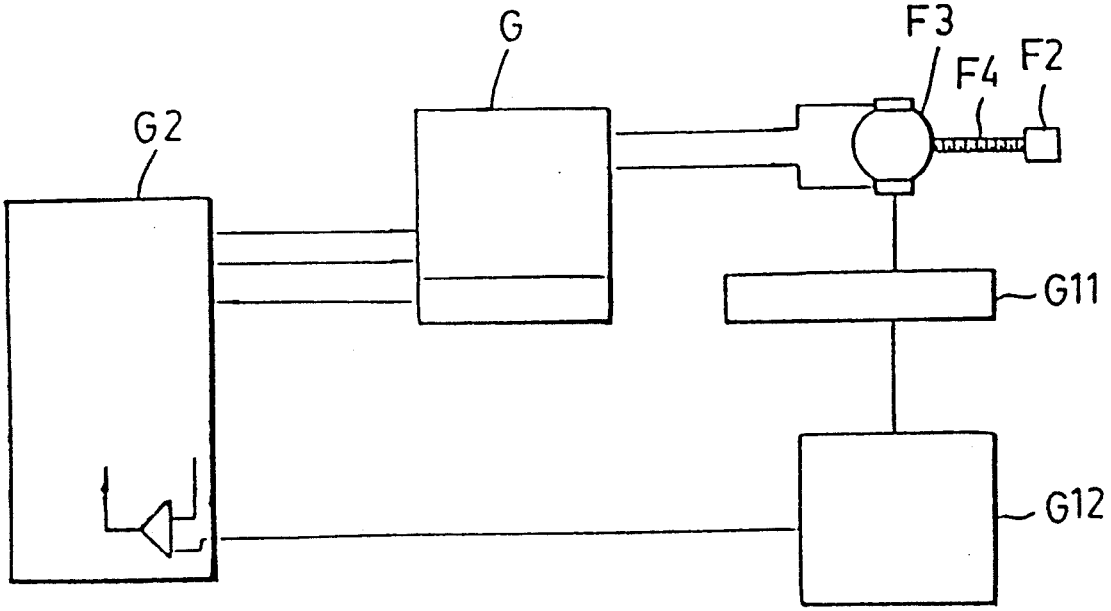
FIG.4 PRIOR ART
FIG. 4 is a schematic circuit block diagram of a motor control unit of the conventional magnet-type resistance generator.

Referring to FIG. 7, the magnet unit 40 is shown to be similar in construction with the magnet unit (B) of the conventional resistance generator shown in FIG. 1. The magnet unit 40 includes a curved housing 420 which has a U-shaped horizontal cross-section. The curved housing 420 confines a groove 41 and has opposite inner wall surfaces that are respectively provided with a plurality of permanent magnets 42 which extend into the groove 41. The distribution of the polarities of the permanent magnets 42 is similar to that of the magnet unit (B) shown in FIG. 1. The shape of the groove 41 conforms with the periphery of the driven flywheel 30. The magnet unit 40 is movable toward and away from the periphery of the driven flywheel 30. When the magnet unit 40 moves toward the driven flywheel 30, the periphery of the driven flywheel 30 extends into the groove 41 so as to cut into the magnetic field within the groove 41. The curved housing 420 has an outer wall surface which is formed with a tubular projection 410 that confines a hollow axial space 411.

Figure 8:
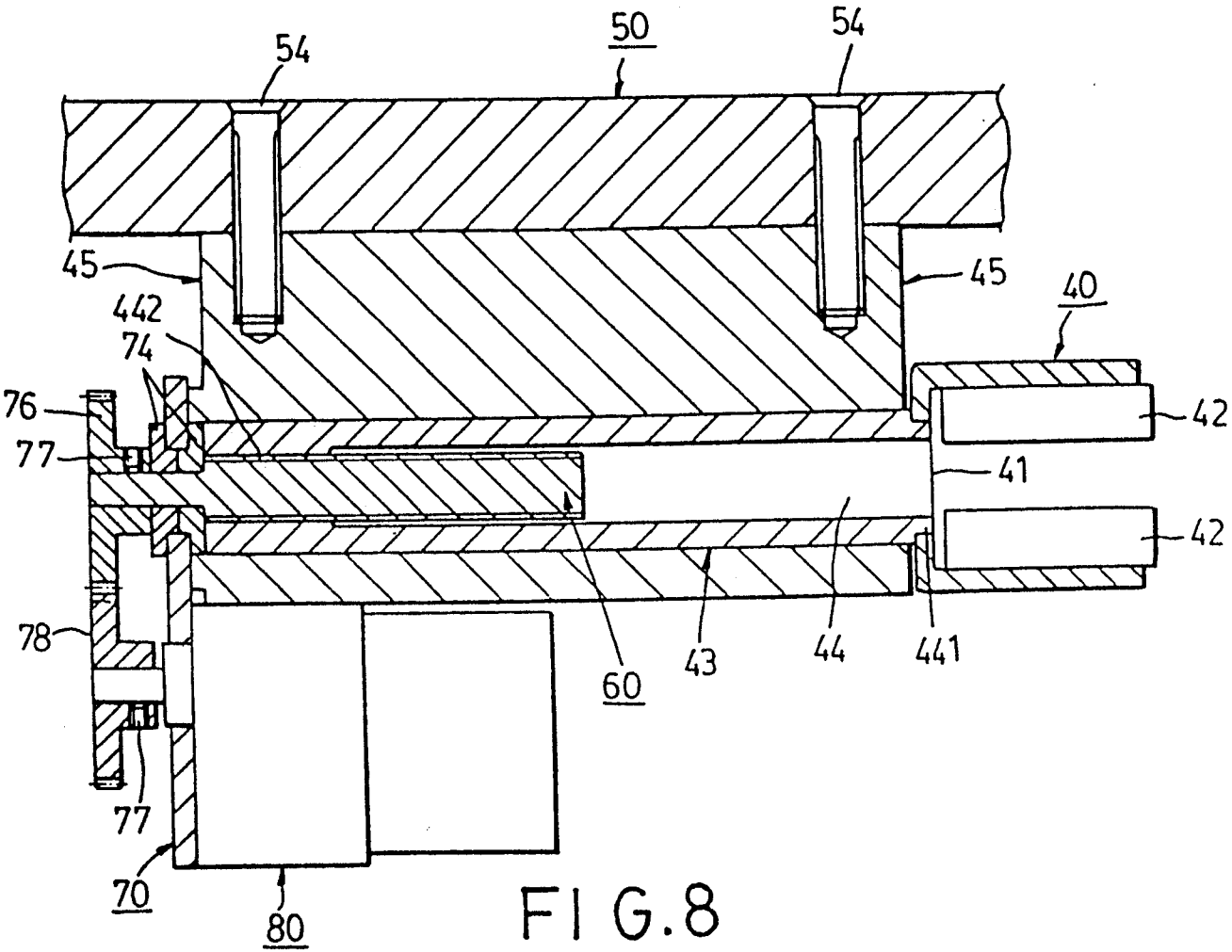
FIG. 8 is a sectional view illustrating the assembly of the preferred embodiment.

Referring to FIGS. 7 and 8, the tubular threaded sleeve 43 is an elongated polygonal metal body. In this embodiment, the sleeve 43 is hexagonal in cross-section and confines a circular through hole 44. The sleeve 43 has one end which is formed with an annular axial flange 441 that extends into a hole formed in a rear side of the curved housing 420 of the magnet unit 40. The axial flange 441 is welded onto the curved housing 420, thereby enabling the sleeve 43 to extend from the rear side of the curved housing 420. The other end of the sleeve 43 is formed with an internally threaded portion 442. The internally threaded portion 442 has an internal diameter which is slightly smaller than that of the through hole 44.

The tubular slide seat 45 confines a through hole 46 that corresponds with the shape of the sleeve 43. In this embodiment, the through hole 46 is hexagonal in cross-section and receives slidably the sleeve 43 therein. The slide seat 45 has an external side which is formed with a pair of screw holes 47.

Referring to FIGS. 6 and 7, the inclined support 50 has one end which secured to the lower end of the seat support 13 by means of a screw fastener 51. A metal tube (50*a*) is welded onto the other end of the inclined support 50. The metal tube (50*a*) is secured to the front shaft 31. The inclined support 50 is formed with a spaced pair of through openings 52 and a spaced pair of screw holes 53. Screws 54 pass through washers 55 and the through openings 52 and engage the screw holes 47, thereby securing the slide seat 45 on the inclined support 50.

The guide bolt 60 has a threaded portion 62 and a distal diameter-reduced portion 61. The guide bolt 60 extends into the slide seat 45, and the threaded portion 62 engages the internally threaded portion 442 of the sleeve 43 and does not contact the surface which defines the through hole 44 of the sleeve 43.

The mounting plate 70 is an oval-shaped metal plate which is formed with a pair of through openings 71, 72. Three small;; through holes 73 are formed around each of the through openings 71, 72. Bushings 74 are disposed on two sides of the mounting plate 70 in the through opening 71. Screws 75 pass through the through holes 73 and engage the screw holes 48 formed on one end of the slide seat 45 in order to secure the mounting plate 70 on the slide seat 45. The distal portion 61 of the guide bolt 60 extends through the bushings 74 and into a sleeve portion 761 of a transmission gear 76. The sleeve portion 761 is formed with a radial screw hole 760 to permit the extension of a screw 77 therein in order to secure the distal portion 61 of the guide bolt 60 to the transmission gear 76.

The motor 80 is a dc motor and has an axle 81 which extends through the through opening 72. Screws 75 pass through the mounting plate 70 at the through holes 73 around the through opening 72 and engage the screw holes 82 formed on one end of the motor 80 in order to secure the motor 80 on the mounting plate 70. The axle 81 extends into a sleeve portion 781 of a transmission gear 78. The transmission gear 78 meshes with the transmission gear 76. The sleeve portion 781 is formed with a radial screw hole 780 to permit the extension of a screw 77 therein in order to secure the axle 81 to the transmission gear 78.

The mounting plate 90 has an L-shaped vertical cross-section and includes a vertical plate portion 901 which is formed with a spaced pair of through holes 91 and a spaced pair of screw holes (91*a*). The screw holes (91*a*) are disposed adjacent to a bottom edge of the vertical plate portion 901. A horizontally extending slot 92 is formed between the screw holes (91*a*). Screws 93 extend through the through holes 91 and engage the screw holes 53 of the inclined support 50 in order to mount the mounting plate 90 on the inclined support 50.

Figure 9:
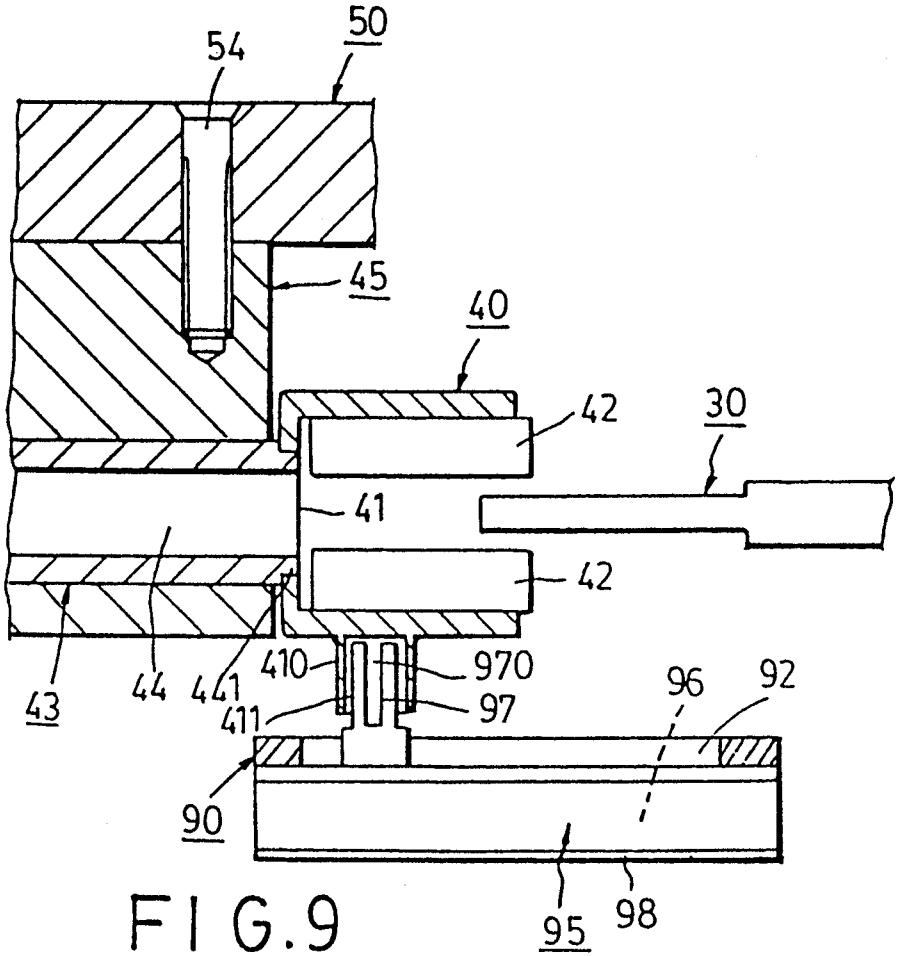
FIG. 9 is a sectional view illustrating the connection between a magnet unit and a slide potentiometer of the preferred embodiment.

The slide potentiometer 95 has a rectangular housing 96 with a slider 97 provided slidably thereon. The slider 97 has a forked end 970. The housing 96 has two ends which are respectively formed with a through hole 960. A circuit board 98 is provided on a rear side of the housing 96. The slider 97 extends through the slot 92 of the mounting plate 90. Referring to FIG. 9, the forked end 970 of the slider 97 extends into the axial space 411 of the tubular projection 410 of the magnet unit 40. Screws 99 pass through the circuit board 98 and the through holes 960 of the housing 96 and engage the screw holes (91*a*) of the mounting plate 90, thereby mounting the slide potentiometer 95 on the mounting plate 90. The slider 97 moves frontward and rearward with the magnet unit 40. The circuit board 98 is provided with a cable unit 981 that is connected electrically with the instrument control unit 15.

As with the conventional resistance generator described hereinbefore, the instrument control unit 15 includes a voltage sensor that is connected to a computer. The computer is connected to a motor control unit which, in turn, is connected to the motor 80 so as to control the rotation of the latter.

Figure 10:
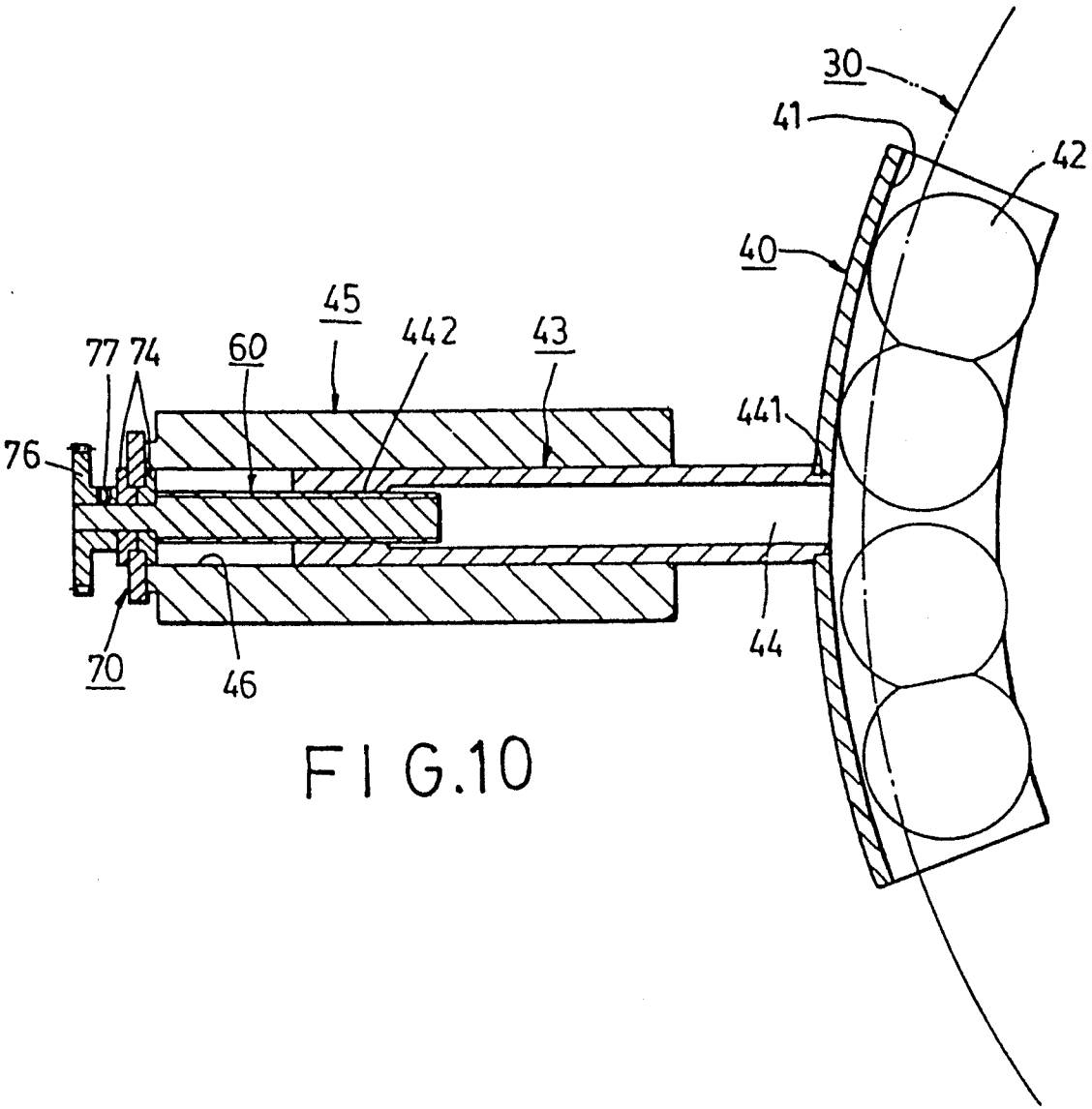
FIG. 10 is a sectional view of the preferred embodiment when in a first operating state.
Figure 11:
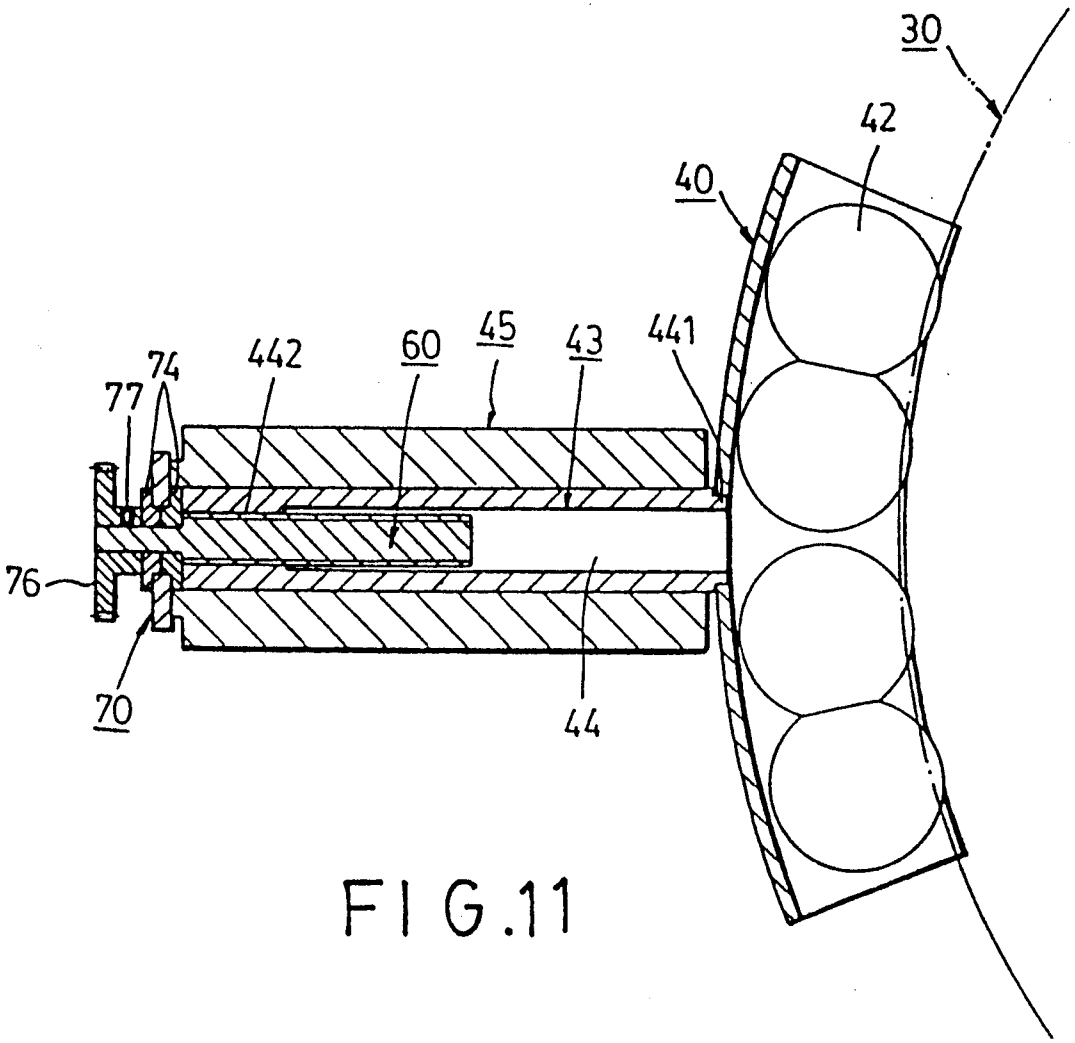
FIG. 11 is a sectional view of the preferred embodiment when in a second operating state.

The following is a brief description of the operation of the preferred embodiment:

Referring to FIGS. 5, 10, and 11, the instrument control unit 15 is operated so as to adjust the resistance that is to be provided to the flywheel 30 of the exercise apparatus to the desired level. The computer, which is disposed in the instrument control unit 15, commands the motor control unit to activate the motor 80.

When the pedals 23 are operated, the driving element 34 rotates to drive rotatably the driving wheel 21 and the flywheel 30. When the axle 81 of the motor 80 rotates, the transmission gears 76, 78 rotate therewith, thereby rotating the guide bolt 60 axially. Rotation of the guide bolt 60 causes the sleeve 43 to move slidably along the through hole 46 of the slide seat 45, thereby moving the magnet unit 45 toward or away from the flywheel 30. At the same time, the slider 97 moves with the magnet unit 45, thereby adjusting the resistance output of the slide potentiometer 95. The voltage sensor of the instrument control unit 15 generates a control signal to the computer in accordance with the instantaneous resistance output of the slide potentiometer 95. The computer continues to command the motor control unit to activate the motor 80 until the periphery of the flywheel 30 cuts by a desired depth into the magnetic field that is generated by the magnet unit 40 in order to attain the desired resistance to the rotation of the flywheel 30, as shown in FIG. 10. FIG. 11 illustrates the flywheel 30 when it ceases to cut into the magnetic field that is generated by the magnet unit 40.

The magnet-type resistance generator of the preferred embodiment has a relatively small tolerance. Because the magnet unit 40 is connected directly to the guide bolt 60, the flywheel 30 can be easily disposed in the center of the groove 41 of the magnet unit 40 so as to cut equally through the magnetic field in the latter. Therefore, an unstable resistance to the rotation of the flywheel 30 seldom occurs. The exercise apparatus which incorporates the present invention is thus comfortable to use when compared to one which incorporates the previously described conventional resistance generator.

Note that the present invention may be installed in an exercise bicycle, a stationary rower, and the like. In addition, proper installation and adjustment of the magnet unit 40 can be achieved with ease. When the magnet unit 40 accidentally bumps into an object, the magnet unit 40 can be adjusted in order to replace the flywheel 30 to its proper position. Furthermore, since the resistance to the rotation of the flywheel 30 is maintained even, an accurate calorie loss can be computed by the instrument control unit 15.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A magnet-type resistance generator for an exercise apparatus, said exercise apparatus including a frame assembly, a flywheel mounted rotatably on said frame assembly, and a manually operated driving unit for driving rotatably said flywheel, said magnet-type resistance generator comprising:

a magnet unit including a curved housing which has a U-shaped horizontal cross-section, said curved housing confining a groove and having opposite inner wall surfaces that are respectively provided with a plurality of permanent magnets which extend into said groove, said groove having a shape which conforms with a periphery of said flywheel;

a tubular sleeve extending from a rear side of said curved housing and having a distal end which is formed with an internally threaded portion;

a tubular slide seat mounted on said frame assembly adjacent to said flywheel, said slide seat confining a through hole to receive slidably said tubular sleeve therein;

a guide bolt extending axially into said slide seat and having a threaded portion that engages said internally threaded portion of said tubular sleeve, said guide bolt further having a distal end which extends out of said slide seat and which is provided with a first transmission gear;

a motor having an axle which is provided with a second transmission gear that meshes with said first transmission gear;

a slide potentiometer mounted on said frame assembly, said slide potentiometer having a slider connected to said curved housing of said magnet unit; and an instrument control unit mounted on said frame assembly and connected electrically to said slide potentiometer, said instrument control unit activating said motor to rotate said guide bolt axially and cause said tubular sleeve to move slidably along said through hole of said slide seat, thereby moving said magnet unit toward or away from said periphery of said flywheel so that said periphery of said flywheel can extend into said groove of said curved housing by a desired depth in order to attain a desired resistance to rotation of said flywheel, said slider moving with said magnet unit to permit said slide potentiometer to control said instrument control panel to deactivate said motor when the desired depth has been reached.

2. The magnet-type resistance generator as claimed in claim 1, wherein said tubular sleeve is polygonal in cross-section, and said through hole of said slide seat corresponds with the cross-section of said tubular sleeve.

* * * * *